United States Patent [19]

Harada et al.

[11] Patent Number: 4,463,676

[45] Date of Patent: Aug. 7, 1984

[54] PRINTING APPARATUS

[75] Inventors: Mineo Harada, Owariasahi; Yutaka Kako, Kasugai, both of Japan

[73] Assignee: Hitachi, Ltd., Tokyo, Japan

[21] Appl. No.: 402,414

[22] Filed: Jul. 28, 1982

[30] Foreign Application Priority Data

Aug. 21, 1981 [JP] Japan ..... 56-131211

[51] Int. Cl.[3] ..... B41J 3/02

[52] U.S. Cl. ..... 101/212; 101/382 MV; 101/93.04; 400/119; 400/121; 346/74.2

[58] Field of Search ..... 400/118, 119, 121; 101/382 MV, 382 R, DIG. 5, 93.04, 212; 346/21, 74.2, 74.5

[56] References Cited

U.S. PATENT DOCUMENTS

| | | | |
|---|---|---|---|
| 2,884,348 | 4/1959 | Kulesza | 346/21 X |
| 4,108,066 | 8/1978 | Andersson | 400/118 |
| 4,321,606 | 3/1982 | Lazzari | 101/113 X |
| 4,351,617 | 9/1982 | Landa | 400/118 |

FOREIGN PATENT DOCUMENTS

| | | | |
|---|---|---|---|
| 3006751 | 9/1980 | Fed. Rep. of Germany | 101/DIG. 5 |
| WO81/01120 | 4/1981 | PCT Int'l Appl. | 400/119 |
| 635115 | 4/1950 | United Kingdom | 101/31 |

*Primary Examiner*—Edgar S. Burr
*Assistant Examiner*—Charles A. Pearson
*Attorney, Agent, or Firm*—Antonelli, Terry & Wands

[57] ABSTRACT

There is disclosed in this application a printing apparatus including small balls of magnetic material prepared in large numbers as printing elements for forming characters or symbols. a wheel having a surface made of ferromagnetic material, a magnetizing head for magnetizing the surface of the wheel to cause the small balls to be magnetically attracted thereto, and an erasing head for demagnetizing the surface of the wheel to remove the magnetically attracted small balls therefrom. As the wheel is brought into pressing engagement with sheets while rotating, images of characters or symbols are formed on the sheets in the form of a pattern formed from a combination of the small balls. The trouble of noise production when printing is carried out can be eliminated because the sheets are brought into pressing engagement with the surface of the wheel while the wheel is rotating.

3 Claims, 4 Drawing Figures

PRINTING APPARATUS

BACKGROUND OF THE INVENTION (1) Field of the Invention

This invention relates to printing apparatus, and more particularly it is concerned with a serial printing apparatus of the impact-free type capable of effecting printing simultaneously on a plurality of sheets.

(2) Description of the Prior Art

Printing apparatus of the impact type known in the art suitable for effecting printing simultaneously on a plurality of pressure-sensitive sheets piled one over another include a printing apparatus of the matrix type system and a printing apparatus of the wire dot system. In these two systems of printing apparatus, a matrix type, a hammer or a wire serving as a printing member strikes a plurality of sheets with an impact and a force of impact generated by the printing member is transmitted to the sheets in one operation, to enable copying of the plurality of sheets to be effected. The greatest disadvantage this type of printing apparatus suffers is that the noise produced when the printing member strikes the sheets with an impact is great.

Meanwhile printing apparatus of the nonimpact type, such as ink jet printing apparatus, thermal printing apparatus and laser beam printing apparatus do not produce noise of impact. However, they suffer the disadvantage that it is impossible for them to effect printing simultaneously on a plurality of sheets.

SUMMARY OF THE INVENTION (1) Objects of the Invention

An object of this invention is to provide a printing apparatus capable of performing printing without producing noise in performing printing.

Another object is to provide a printing apparatus of the pressure application type capable of effecting printing simultaneously on a plurality of sheets set in superposed relation one over another.

Still another object is to provide a serial printing apparatus capable of effecting printing of any characters or symbols as desired by using dots in different combinations.

(2) Statement of the Invention

According to the invention, there is provided a printing apparatus comprising a rotary member of the cylindrical shape of which at least an outer circumferential surface is made of magnetic material, a magnetizing head for magnetizing the outer circumferential surface of the rotary member in accordance with patterns of characters or symbols to be printed, and means for supplying elements to be attached to magnetized regions on the rotary member so that the elements will form the patterns of the characters or symbols to be printed. The elements may, for example, be small balls which, when attached to the surface of the rotary member, form projections in accordance with the patterns of the characters or symbols to be printed. Meanwhile a printing medium, such as self-pressure-sensitive paper, of the known type is set on the platen. The rotary member moves in sliding movement in a predetermined direction while rotating with the outer circumferential surface of the rotary member being pressed against the printing medium on the platen. Thus the patterns of the characters or symbols to be printed provided by the combination of the elements are formed on the surface of the printing medium.

When characters or symbols of various types are to be printed on the printing medium, it is necessary that the aforesaid operation is repeatedly performed. To this end, an erasing head is provided for releasing the elements from attraction by magnetism to the rotary member, to be located in a position in which the rotary member rotates after being released from engagement with the printing medium. The erasing head has the function of demagnetizing the surface of the rotary member to remove the elements therefrom. Thus the rotary member rotates and reaches the position of the magnetizing head where new patterns are formed by the magnetizing head on the surface of the rotary member.

In the printing apparatus according to the invention, printing can be effected as the surface of the rotary member having patterns of characters or symbols to be printed formed thereon in projections is pressed against the printing medium while the rotary member rotates. This construction is conducive to a reduction in noise produced when printing is carried out, as compared with known impact printing apparatus. The desired patterns can be formed in excellent condition on a plurality of printing sheets superposed one over another because a pressing force produced by the rotary member and forced at its surface against the printing medium is exerted on the plurality of overlapping printing sheets. The provision of the erasing head enables the patterns of the desired characters or symbols to be readily formed on the surface of the rotary member.

DETAILED DESCRIPTION OF THE PREFERRED EMBODIMENT

Figure 1:
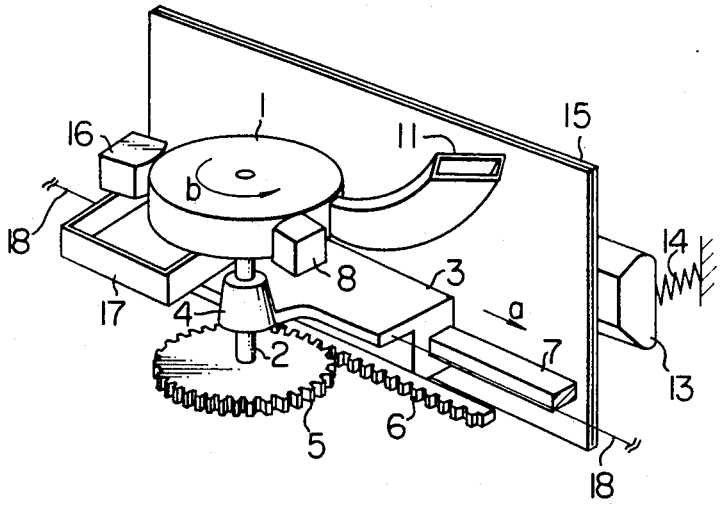
FIG. 1 is a perspective view of the printing apparatus comprising one embodiment of the invention, showing its essential portions.

FIG. 1 is a perspective view of the serial printing apparatus comprising one embodiment of the invention. As shown, a wheel 1 serving as a rotary member is formed at its outer circumferential surface of a ferromagnetic material. The magnetic wheel 1 has secured to, at the central portion thereof, a shaft 2 supported for rotation by a bearing 4 mounted on a carriage 3 and the shaft 2 having a gear 5 attached to an end thereof opposite to the end at which the wheel 1 is attached. The gear 5 meshes with a rack 6 arranged parallel to the direction of movement of the carriage 3.

The carriage 3 is of a well-known type for supporting a printing head in a known serial printing apparatus. The carriage 3 is supported on a rail 7 and pulled by a wire 18 to move on the rail 7 in sliding movement. The wire 18 is wound at opposite ends thereof on spools, not shown, which are rotated to pull the wire 18 in either direction as desired.

A platen 13 is located parallel to the rail 7 and urged by the biasing force of a pressure-applying spring 14 to move toward the magnetic wheel 1 while being maintained parallel to the direction of movement of the carriage 3. One sheet or a plurality of sheets 15 superposed one over another is arranged between the platen 13 and the magnetic wheel 1. An ink ribbon, not shown, of the known type is interposed between the sheets 15 and the magnetic wheel 1 in a known manner. A known stopper, not shown, is provided to the front surface of the sheets 15 so as to lock the sheets 15 pressed by the platen 13 in place.

As the carriage 3 moves on the rail 7, the magnetic wheel 1 rotates by an amount proportional to the distance covered by the movement of the carriage 3. A magnetizing head 8 for partially magnetizing the outer circumferential surface of the magnetic wheel 1 is located on one side of the magnetic wheel in one position in which the head 8 is in intimate contact with or slightly spaced apart from the magnetic wheel 1. The magnetizing head 8 may be of a known construction having seven independent magnetizing areas arranged in a vertical row.

Figure 2:
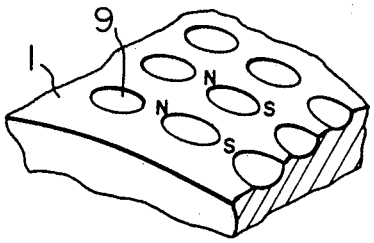
FIG. 2 is a perspective view showing, on an enlarged scale, a portion of the magnetic wheel.

FIG. 2 shows in a perspective view a portion of the magnetic wheel 1. As shown, the magnetic wheel 1 has formed on its surface with semispherical recesses or dimples 9 reticulately, the dimples 9 being spaced apart from one another by a distance corresponding to the distance separating the magnetizing areas of the magnetizing head 8 from one another. Thus as the magnetizing head 8 is passed by the magnetic wheel 1, the selected dimples 9 have their surrounding regions magnetized as shown.

Figure 3:
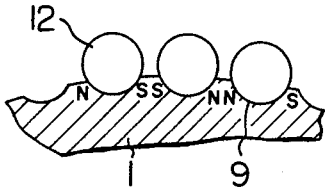
FIG. 3 is a fragmentary sectional view of the magnetic wheel showing, on an enlarged scale, the manner in which the small balls are magnetically attracted to the surface of the magnetic wheel.

Referring to FIG. 1 again, a chute 11 for supplying small balls 12 (see FIG. 3) of magnetic material to the outer circumferential surface of the magnetic wheel 1 that has passed by the magnetizing head 8 is located with its open forward end being disposed close to the outer circumferential surface of the magnetic wheel 1. The chute 11 has the small balls 12 of magnetic material stored therein and attracted, when supplied to the surface of the magnetic wheel 1, to the magnetized dimples 9 in such a manner that their bodies stick in part out of the dimples 9. No small balls 12 are attracted to non-magnetized dimples 9. FIG. 3 shows the manner in which the small balls 12 are attracted to the magnetized dimples 9 on the surface of the magnetic wheel 1.

To remove the small balls 12 attracted to the dimples 9 on the surface of the magnetic wheel 1, an erasing head 16 is located in a position in which it is juxtaposed against the outer circumferential surface of the magnetic wheel 1. As the outer circumferential surface of the magnetic wheel 1 passes by the erasing head 16 of known construction, the small balls 12 attracted to the magnetic wheel 1 and the magnetic wheel 1 itself are demagnetized, to allow the small balls 12 to be recovered by causing same to drop into a recovery box 17.

Operation of the printing apparatus of the aforesaid construction will be described. The carriage 3 moves in the direction of an arrow a shown in FIG. 1 as the wire 18 is pulled in the direction of the arrow a. By the cooperation of the rack 6 with the gear 5, the magnetic wheel 1 rotates in the direction of an arrow b at a peripheral velocity (to be exact, the velocity measured at the projecting ends of the small balls attracted to the dimples) equal to the velocity at which the carriage 3 moves along a linear path.

Figure 4:
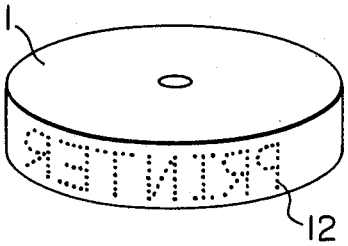
FIG. 4 is a perspective view of the magnetic wheel, showing the manner in which the small balls are magnetically attracted to the outer circumferential surface of the magnetic wheel in accordance with patterns of the characters to be printed.

In the same manner as dot pattern currents are passed to a printing head of a known printing apparatus of the dot matrix type, dot pattern currents corresponding to the characters or symbols to be printed are supplied in order, with one vertical row serving as a unit, to the magnetizing head 8 from a control means, not shown. Thus, as the magnetic wheel 1 passes by the magnetizing head 8, those dimples 9 on the outer circumferential surface of the magnetic wheel 1 which correspond to black dots of the dot pattern of the characters or symbols are selectively magnetized. As the magnetic wheel 1 passes by the open end of the chute 11, the small balls 12 are selectively attracted only to the magnetized dimples 9. This allows the small balls 12 to be attracted to the outer circumferential surface of the magnetic wheel 1 in a pattern corresponding to the dot pattern of the characters or symbols to be printed. FIG. 4 shows the manner in which the small balls 12 are attracted to the outer circumferential surface of the magnetic wheel 1 as described hereinabove.

The small balls 12 thus attracted to the outer circumferential surface of the magnetic wheel 1 pass through a position in which they are brought into contact with the sheets 15, as the magnetic wheel 1 rotates. At this time, the platen 13 urged by the biasing force of the spring 14 forces the sheets 15 against the small balls 12 through the ink ribbon, not shown. This results in that characters or symbols corresponding to the pattern of the small balls 12 attracted to the magnetic wheel 1 are printed on the sheets 15 in a dot pattern. As aforesaid, the printing apparatus according to the invention uses a static pressing force in printing characters or symbols, so that there is no noise which occurs in an impact printing apparatus when printing is carried out. It will be evident that since a pressing force is exerted on the sheets 15 when printing is carried out, it is possible to print characters or symbols simultaneously on a plurality of sheets if the sheets 15 consist of copying paper having more than two sheets superposed one over another as used with an impact printing apparatus.

The arrangement whereby the small balls 12 are inserted in part in the dimples 9 offers the advantage that the quality of the printed characters or symbols can be increased because the accuracy with which the small balls are attracted to the proper positions on the surface of the magnetic wheel can be increased and the prevention of deviations from the proper position of the small balls that might be caused by the pressing force applied to the sheets to force same against the small balls can be made. The results of the experiments conducted show that the small balls 12 can advantageously be supported in the dimples 9 when the small balls 12 project outwardly from the outer circumferential surface of the magnetic wheel 1 by about 0.2 mm. It is to be understood that the value described herein is for purposes of illustration only and that the invention is not limited to this value. The stopper, not shown, for preventing the movement of the platen 13 toward the magnetic wheel 1 has the function of maintaining a predetermined minimum clearance between the outer peripheral surface of the magnetic wheel 1 and the sheets 15 when no small balls 12 are attracted to the dimples 9.

The small balls 12 attracted to the dimples 9 on the outer circumferential surface of the magnetic wheel 1 reach, after they have passed through the printing position, the erasing head 16, where the small balls 12 drop from the magnetic wheel 1 into the recovery box 17, to be recovered for reuse.

The small balls 12 stored in the chute 11 gradually become smaller in number, so that it is necessary that the chute 11 be periodically replenished to allow the small balls 12 to be stored in the chute 11 in a suitable number at all times. It is practical to carry out replenishing of the chute 11 automatically, and the mechanism for carrying out this operation can be readily realized, so that description and showing thereof will be omitted. It would be effective to provide means whereby the small balls 12 recovered into the recovery box 17 can be automatically returned to the chute 11.

While the invention has been described by referring to a preferred embodiment thereof, it is to be understood that the invention is not limited to the specific form of the embodiment shown and described hereinabove and that many changes and modifications may be made therein without departing from the scope of the invention.

For example, the small balls attracted to the magnetic wheel 1 may be coated with ink previously to eliminate the need to use an ink ribbon. If self-pressure-sensitive paper of the type capable of developing a color by application of pressure were used, the ink ribbon can, of course, be eliminated in the printing apparatus of the aforesaid construction as it is.

The magnetic wheel may be in the form of an elongated drum or numbers of magnetic wheels may be used, to enable the full range of the sheet width to be covered in one operation, so that a single line of characters or symbols can be printed in one operation.

The embodiment shown and described hereinabove may be modified in such a manner that in the printing apparatus shown in FIG. 1, the mechanism consisting of the gear 5 and the rack 6 for rotating the wheel 1 may be eliminated and instead of this mechanism a known motor may be used for rotating the wheel 1, the motor driving in synchronism with the sliding movement of the carriage 3.

What is claimed is:

1. A printing apparatus capable of simultaneously producing a plurality of printed copies on superimposed layers of a printing medium comprising:

(a) a platen against which a printing medium is supportable;

(b) a rotary member brought into pressing engagement with said printing medium which is supported against said platen while said rotary member is rotating, at least the surface of said rotary member to be brought into pressing engagement with said printing medium being made of magnetic material;

(c) magnetizing means for magnetizing said surface at which said rotary member is to be brought into pressing engagement with said printing medium, to enable any patterns of information to be printed to be formed on said surface as a combination of spaced individual reusable rigid printing elements;

(d) means for supplying said reusable rigid printing elements to said surface to form spaced projections of individual reusable rigid printing elements in accordance with said patterns of information by attaching each of said reusable rigid printing elements to a respective magnetized area on said surface; and (e) means for erasing at least said magnetized areas on said surface to remove said reusable rigid printing elements attached to said magnetized areas;

said reusable rigid elements being small balls of magnetic material and said surface of said rotary member which is brought into pressing engagement with said printing medium being formed with a plurality of spheric recesses, each of said spheric recesses receiving a part of a respective one of said small balls so that a remaining part thereof projects outwardly from the respective recess.

2. A printing apparatus as claimed in claim 1, further comprising:

(f) a carriage movable in parallel with said platen; and (g) means for rotating said rotary member carried on said carriage with the movement of said carriage.

3. A printing apparatus as claimed in claim 1, comprising recovery means positioned relative to said rotary member and erasing means for recovering said reusable rigid printing elements attached to the magnetized areas on the rotary member when they are removed therefrom by said means for erasing.

* * * * *